US010954653B2

(12) United States Patent
Wang

(10) Patent No.: US 10,954,653 B2
(45) Date of Patent: Mar. 23, 2021

(54) FOUNDATION CONSTRUCTION DEVICE AND ITS CONSTRUCTION METHOD

(71) Applicant: Yubin Wang, Jiangsu (CN)

(72) Inventor: Yubin Wang, Jiangsu (CN)

(73) Assignee: Yubin Wang, Wuxi (CN)

( * ) Notice: Subject to any disclaimer, the term of this patent is extended or adjusted under 35 U.S.C. 154(b) by 0 days.

(21) Appl. No.: 16/495,080

(22) PCT Filed: Mar. 16, 2018

(86) PCT No.: PCT/CN2018/079252

§ 371 (c)(1),
(2) Date: Sep. 17, 2019

(87) PCT Pub. No.: WO2018/166518

PCT Pub. Date: Sep. 20, 2018

(65) Prior Publication Data

US 2020/0095747 A1 Mar. 26, 2020

(30) Foreign Application Priority Data

Mar. 17, 2017 (CN) ..... 201710162254.7

(51) Int. Cl.

| | |
|---|---|
| ***E02F 5/20*** | (2006.01) |
| ***E02D 17/13*** | (2006.01) |
| ***E02F 3/08*** | (2006.01) |
| ***E02D 5/50*** | (2006.01) |
| ***E02D 5/52*** | (2006.01) |
| ***E02F 3/14*** | (2006.01) |

(52) U.S. Cl.

CPC ..... *E02F 5/20* (2013.01); *E02D 5/523* (2013.01); *E02D 17/13* (2013.01); *E02F 3/086* (2013.01); *E02F 3/146* (2013.01)

(58) Field of Classification Search

CPC ..... E02D 15/04; E02D 15/08; E02D 5/50; E02D 5/523; E02D 17/13; E02F 3/08; E02F 5/20

See application file for complete search history.

(56) References Cited

U.S. PATENT DOCUMENTS

| | | | | | |
|---|---|---|---|---|---|
| 4,843,742 | A * | 7/1989 | Camelleri | E02F 3/086 | 37/360 |
| 5,257,471 | A * | 11/1993 | Kitanaka | E02F 3/08 | 37/353 |
| 5,349,765 | A * | 9/1994 | Kitanaka | E02D 19/18 | 37/356 |
| 5,561,923 | A * | 10/1996 | Kitanaka | E02F 3/08 | 37/352 |
| 6,219,945 | B1 * | 4/2001 | Heishi | E02D 17/06 | 37/358 |

(Continued)

FOREIGN PATENT DOCUMENTS

| | | | | |
|---|---|---|---|---|
| CN | 87104708 A * | 3/1988 | E02F 3/08 | |
| JP | 04179726 A * | 6/1992 | E02F 3/08 | |
| JP | 10046623 A * | 2/1998 | | |

*Primary Examiner* — Frederick L Lagman

(74) *Attorney, Agent, or Firm* — Nienstadt PLLC

(57) ABSTRACT

A foundation construction device includes a fixed guiding device and a combined device. The fixed guiding device includes a fixed rack and a guiding device. The combined device includes a chain cutter power transmission device, a spoil treatment device, and a rack.

10 Claims, 19 Drawing Sheets

(56) References Cited

U.S. PATENT DOCUMENTS

| | | | | |
|---|---|---|---|---|
| 6,574,893 | B2 * | 6/2003 | Mizutani | E02D 19/18 37/352 |
| 2011/0113658 | A1 * | 5/2011 | Shreider | E02D 17/13 37/462 |
| 2019/0376252 | A1 * | 12/2019 | Wang | E02F 3/083 |

* cited by examiner

From direction I

Cross-sectional view IV-IV

From direction I

From direction II

Cross-sectional view III-III

FOUNDATION CONSTRUCTION DEVICE AND ITS CONSTRUCTION METHOD

CLAIM FOR PRIORITY

This application is a U.S. national phase of International Application No. PCT/CN2018/079252, filed Mar. 16, 2018, titled "Foundation Construction Device and Construction Method Therefor," which claims priority to CN Patent Application No. 201710162254.7, filed Mar. 17, 2017, all of which are incorporated herein by reference in their entireties.

FIELD OF THE INVENTION

The present invention relates to a foundation construction device and its construction method, which belongs to the field of civil engineering foundation construction.

BACKGROUND OF THE INVENTION

By adopting the integral excavation construction method, the existing large-scale pile foundation technology is of long construction period, high labor intensity, and poor working environment safety.

SUMMARY OF THE INVENTION

The present invention provides a foundation construction device and its construction method. Its objective is to overcome the shortcomings of the existing technology. Its main advantages are as follows: The top of the foundation is equipped with a foundation construction device for excavating the rock and soil at the bottom of the foundation, and the factory-prefabricated foundation. It will make the construction work simpler and with a shorter construction period and a lower cost.

The Technical Scheme of the Invention: The foundation construction device includes fixed guide 1 and combined device 2, which is used for the construction of foundation 4 with chain blade 3 at the bottom. Device 1 consists of fixed frame 1-1 and guide 1-2. Device 2 includes chain blade power transmission device 2-1, spoil treatment device 2-2, and rack 2-3. Device 2-1 and device 2-2 are installed on rack 2-3. Device 2-1, foundation 4, and chain blade 3 constitute chain excavating device 5. Foundation 4 is the rack of chain excavating device 5, while chain blade 3 only excavates the rock and soil at the bottom of foundation 4. Chain blade 3 is composed of chain 3-1 and cutter 3-2 fixed on chain 3-1 for rock and soil excavation. Device 1 guides foundation 4 and/or device 2 to make foundation 4 in a straight state. During construction, device 2 is connected with the top of foundation 4, and device 2-1 drives chain blade 3 to run along the track of foundation 4. Chain blade 3 excavates the rock and soil at the bottom of foundation 4, and transports the excavated rock and soil to the top. Device 2-2 separates the rock and soil transported from the bottom of foundation 4 by chain blade 3 from chain blade 3, and device 2 and foundation 4 descend synchronously.

Device 2-1 is composed of chain blade drive device 2-1-1, chain blade tension device 2-1-2, and chain wheel 2-1-3. Rack 2-3 moves within guide 1-2, and foundation 4 also moves within guide 1-2.

The main advantages of the invention are as follows: The top of the foundation is equipped with a foundation construction device for excavating the rock and soil at the bottom of the foundation, and the factory-prefabricated foundation. It will make the construction work simpler and with a shorter construction period and a lower cost.

BRIEF DESCRIPTION OF THE SEVERAL VIEWS OF THE DRAWINGS

FIG. 1 is the fixed guide of the foundation construction device, which is composed of fixed frame 1-1 and guide 1-2; 1-1 is the fixed frame of fixed guide 1; 1-2 is the guide of fixed guide 1; 2 is the combined device of foundation construction device, including chain blade power transmission device 2-1, spoil treatment device 2-2, and rack 2-3; 2A is the combined device connected with the top of slot-type foundation 4A during construction, including chain blade power transmission device 2A-1, spoil treatment device 2A-2, and rack 2A-3; 2B is the combined device connected to the top of combined foundation 4B during construction, including chain blade power transmission device 2B-1, spoil treatment device 2B-2, and rack 2B-3; 2-1 is the power transmission device of chain blade, which is composed of chain blade drive device 2-1-1, chain blade tension device 2-1-2, and chain wheel 2-1-3; 2A-1 is the power transmission device of chain blade on slot-type foundation 4A, which is composed of chain blade drive device 2-1-1, chain blade tension device 2-1-2, and chain wheel 2-1-3; 2B-1 is the power transmission device of chain blade on combined foundation 4B, which is composed of chain blade drive device 2-1-1, chain blade tension device 2-1-2, and chain wheel 2-1-3; 2-1-1 is the chain blade drive device; 2-1-2 is the chain blade tension device; 2-1-3 is chain wheel; 2-2 is the spoil treatment device of combined device 2; 2A-2 is the spoil treatment device of combined device 2A; 2B-2 is the spoil treatment device of combined device 2B; 2-3 is the rack of combined device 2; 2A-3 is the rack of combined device 2A; 2B-3 is the rack of combined device 2B; 3 is the chain blade for excavating the rock and soil, which is composed of chain 3-1 and cutter fixed on chain 3-1 for rock and soil excavation; 3-1 is the chain constituting chain blade 3; 3-1-1 is A universal joint constituting chain universal joint; 3-1-2 is B universal joint constituting chain universal joint; 3-2 is the cutter constituting chain blade 3; 4 is foundation; 4A is slot-type foundation; 4B is combined foundation, which is composed of several slot-type foundations 4A; 4-1 is the first section (i.e. bottom section) of foundation; 4A-1 is the first section (i.e. bottom section) of slot-type foundation; 4B-1 is the first section (i.e. bottom section) of combined foundation; 4-2 is the second section of foundation; 4A-2 is the second foundation of slot-type foundation; 4B-2 is the second section of combined foundation; 5 is chain excavating device, which is composed of device 2-1, foundation 4, and chain blade 3; 5A is the chain excavating device for excavating the rock and soil at the bottom of foundation 4A; 6 is the slurry pipeline device; 6-1 is the slurry pipeline on rack 2-3 in device 2; 6-2 is the slurry nozzle on foundation bottom 4-1; 7 is the side covering shield of 4, and 4 is the foundation which has a blade angle at the bottom.

DETAILED DESCRIPTION OF THE PREFERRED EMBODIMENTS

Figure 1:
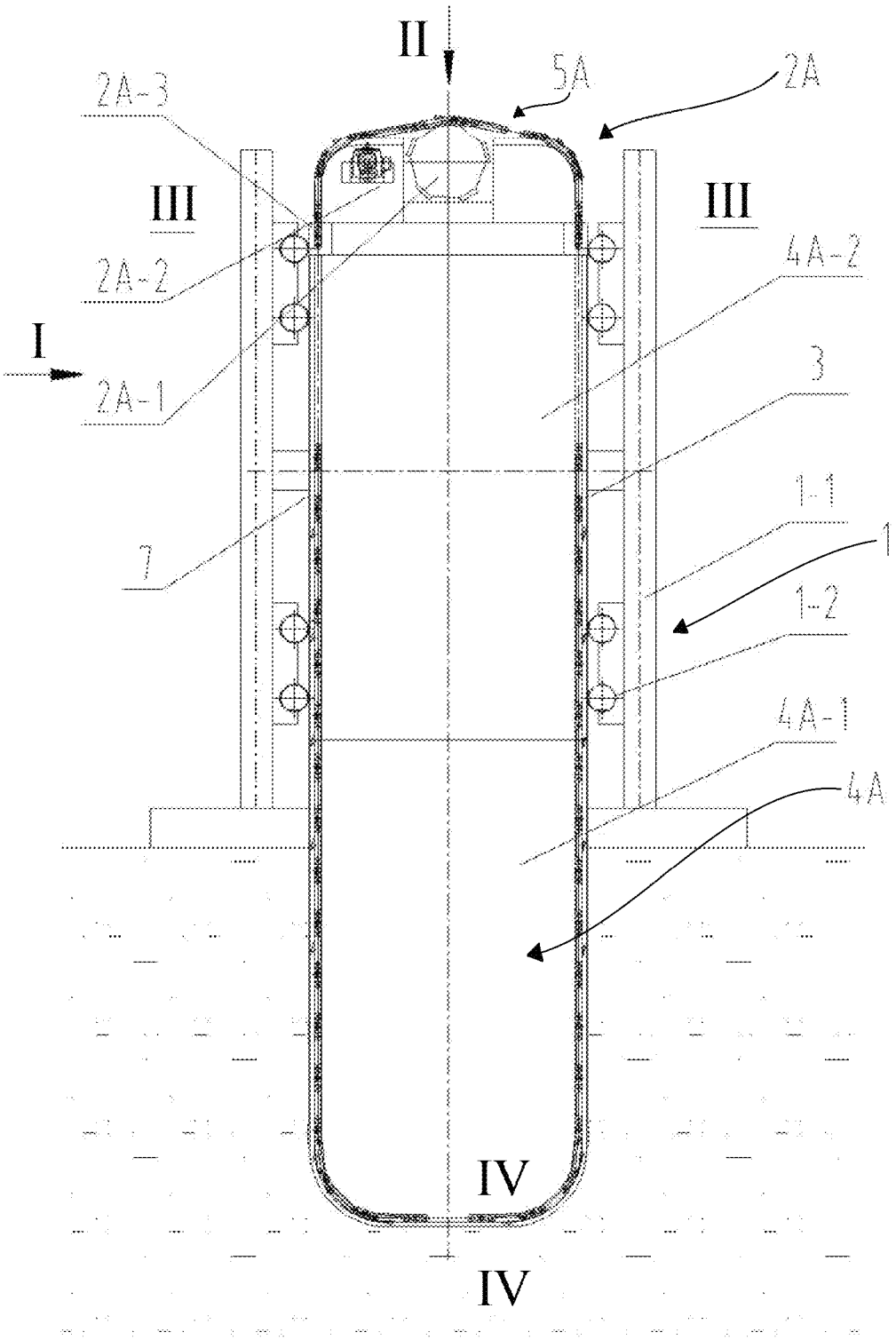
FIG. 1 is a structural schematic diagram of a slot-type foundation 4A whose top is connected with a combined device and a foundation whose bottom is equipped with a chain blade for excavating rock and soil.

The foundation construction device includes fixed guide 1 and combined device 2, which is used for the construction of foundation 4 with chain blade 3 at the bottom. Device 1 consists of fixed frame 1-1 and guide 1-2. Device 2 includes chain blade power transmission device 2-1, spoil treatment device 2-2, and rack 2-3. Device 2-1 and device 2-2 are installed on rack 2-3. Device 2-1, foundation 4 and chain blade 3 constitute chain excavating device 5. Foundation 4 is the rack of chain excavating device 5, while chain blade 3 only excavates the rock and soil at the bottom of foundation 4. Chain blade 3 is composed of chain 3-1 and cutter 3-2 fixed on chain 3-1 for rock and soil excavation. Device 1 guides foundation 4 and/or device 2 to make foundation 4 in a straight state. During construction, device 2 is connected with the top of device 2 and foundation 4, and device 2-1 drives chain blade 3 to run along the track of foundation 4. Chain blade 3 excavates the rock and soil at the bottom of foundation 4, and transports the excavated rock and soil to the top. Device 2-2 separates the rock and soil transported from the bottom of foundation 4 by chain blade 3 from chain blade 3, and device 2 and foundation 4 descend synchronously.

Device 2-1 is composed of chain blade drive device 2-1-1, chain blade tension device 2-1-2, and chain wheel 2-1-3.

Rack 2-3 moves within guide 1-2.

Foundation 4 moves within guide 1-2.

Fixed frame 1-1 is a machinery/construction vehicle or machinery/construction ship.

Foundation 4 is slot-type foundation 4A. During construction, slot-type foundation 4A is equipped with chain excavating device 5A for excavating the rock and soil at the bottom of foundation 4A, that is, frame 2A-3 of device 2A is equipped with a device 2A-1.

The foundation is combined foundation 4B composed of several slot-type foundations 4A. Each slot-type foundation 4A is equipped with chain excavating device 5A that excavates the rock and soil at the bottom of respective foundation 4A only, that is, the frame of device 2B is equipped with several devices 2A-1.

Rack 2-3 in device 2 includes slurry pipeline device 6, and slurry pipeline 6-1 is connected with slurry nozzle 6-2 at the bottom of the foundation.

Fixed frame 1-1 is the construction platform of foundation 4, with a lifting device installed at the top.

The construction method can be divided into the following steps:

1) Pre-fabricate foundation 4 by sections or integrally at the factory;

2) Install and fix frame 1-1 on the spot;

3) Transport the first section (i.e. bottom section) of foundation 4-1 to the site, load it into fixed frame 1-1, and install chain blade 3;

4) Connect the bottom of rack 2-3 in device 2 with the top of the first section of foundation 4-1, connect chain blade 3 at the bottom of device 2 with the chain blade 3 at the top of the first section of foundation 4-1 to constitute chain excavating device 5, and connect slurry pipeline 6-1 at the bottom of device 2 with slurry pipeline 6-1 at the top of the first section of foundation 4-1;

5) Start device 2-1-1, so that device 2-1-1 drives chain blade 3 to move along the track of foundation 4-1, chain blade 3 excavates the rock and soil at the bottom of the first section of foundation 4-1 and transports the excavated rock and soil to the top, and device 2-2 separates the rock and soil transported by chain blade 3 from the bottom of foundation 4-1 from chain blade 3;

6) Device 2 and the first section of foundation 4-1 descend synchronously to the set position;

7) Separate and remove device 2 from the first section of foundation 4-1;

8) Load the second section of foundation 4-2 into frame 1-1;

9) Connect the bottom of the second section of foundation 4-2 with the top of the first section of foundation 4-1, connect chain blade 3 at the bottom of the second section of foundation 4-2 with chain blade 3 at the top of the first section of foundation 4-1, and connect slurry pipeline 6-1 at the bottom of the second section of foundation 4-2 with slurry pipeline 6-1 at the top of the first section of foundation 4-1;

10) Connect the bottom of rack 2-3 in device 2 with the top of the second section of foundation 4-2, connect chain blade 3 at the bottom of device 2 with chain blade 3 at the top of the second section of foundation 4-2 to constitute chain excavating device 4, and connect slurry pipeline 6-1 at the bottom of device 2 with slurry pipeline 6-1 at the top of the second section of foundation 4-2;

11) Start device 2-1-1, so that device 2-1-1 drives chain blade 3 to move along the track of foundation 4-1, chain blade 3 excavates the rock and soil at the bottom of the first section of foundation 4-1 and transports the excavated rock and soil to the top, and device 2-2 separates the rock and soil transported by chain blade 3 from the bottom of foundation 4-1 from chain blade 3;

12) Device 2, first section of foundation 4-1 and second section of foundation 4-2 descend synchronously to the set position;

13) Separate and remove device 2 from the second section of foundation 4-2;

Repeat the above steps 7), 8), 9), 10), 11), and 12) to complete the connection of each section of the foundation and descend to the set position, and then pull out chain blade 3 for concrete pouring.

Figure 2:
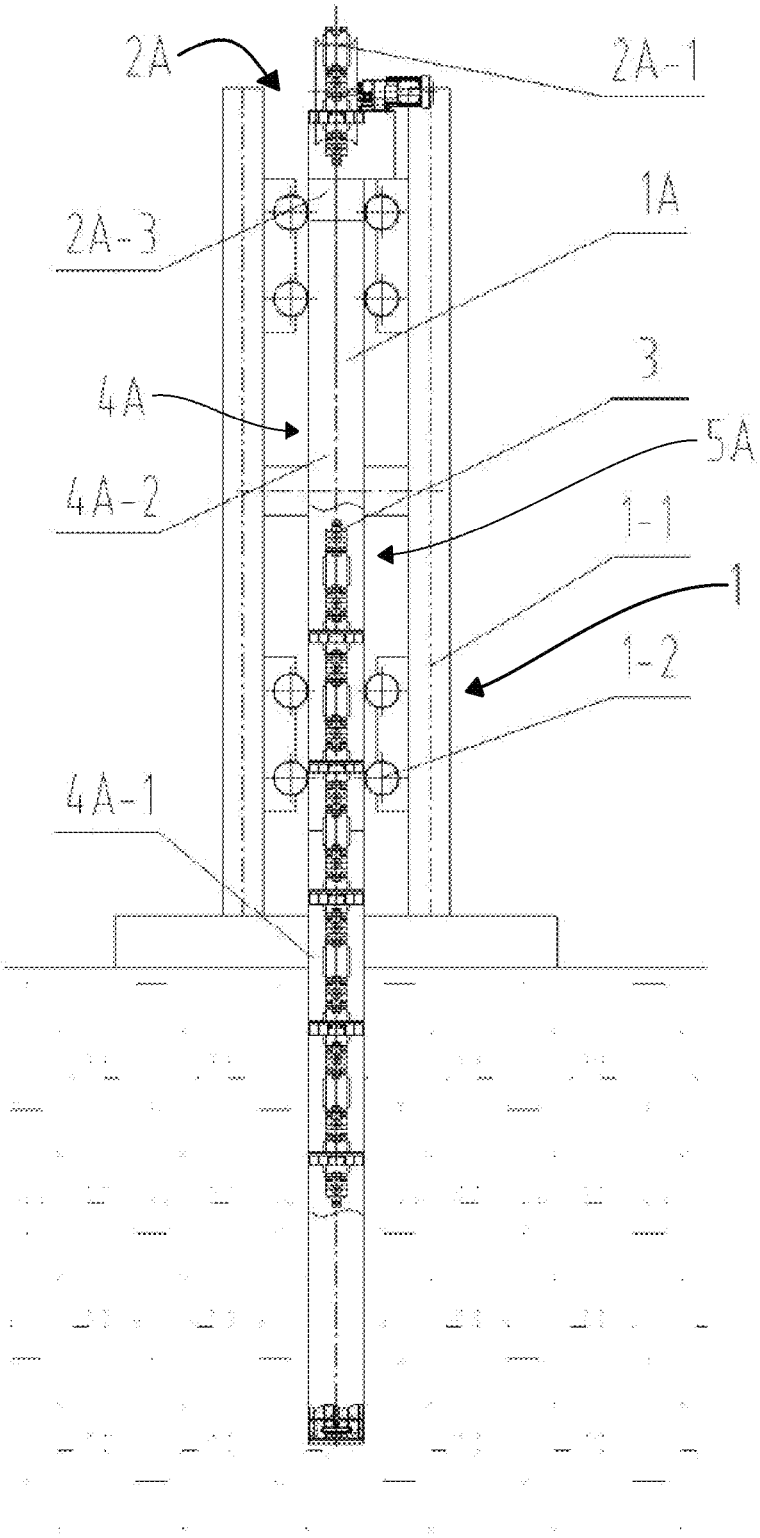
FIG. 2 is the A-view of FIG. 1 showing a chain excavating device and a fixed guide.
Figure 6:
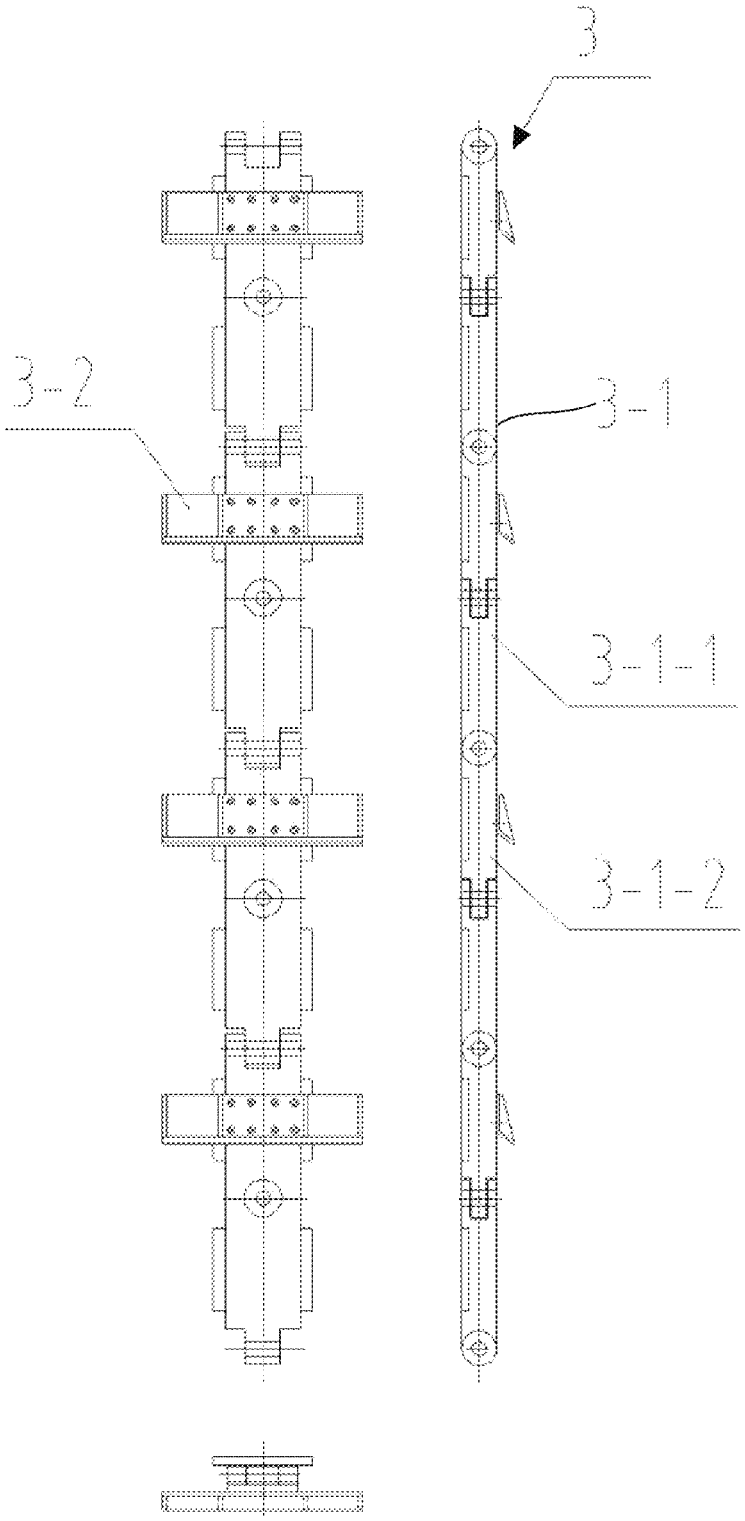
FIG. 6 is a structural schematic diagram of an embodiment of a chain blade.
Figure 7:
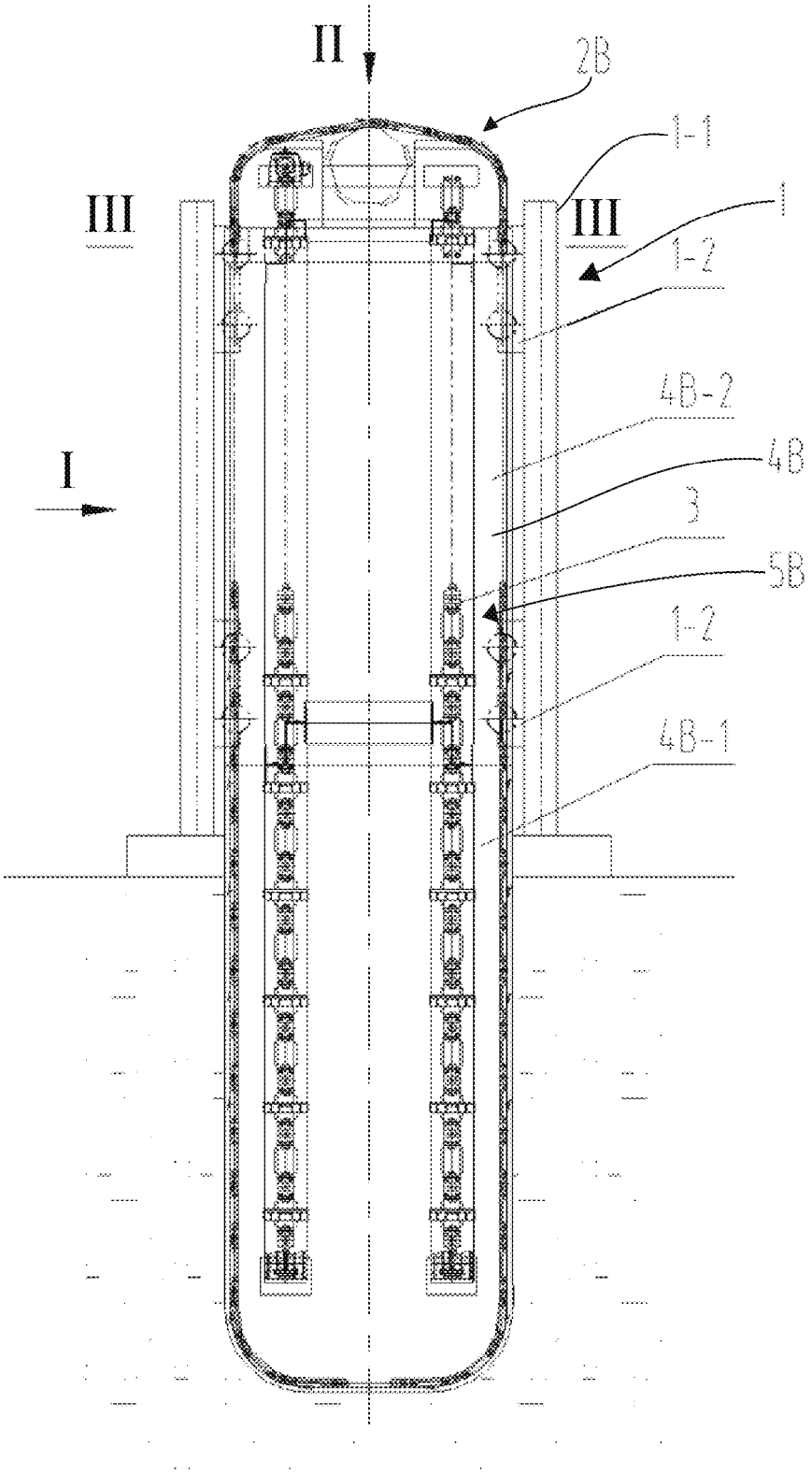
FIG. 7 is a structural schematic diagram of a combined foundation whose top is connected with a combined device and whose bottom is equipped with a chain blade for excavating rock and soil.
Figure 8:
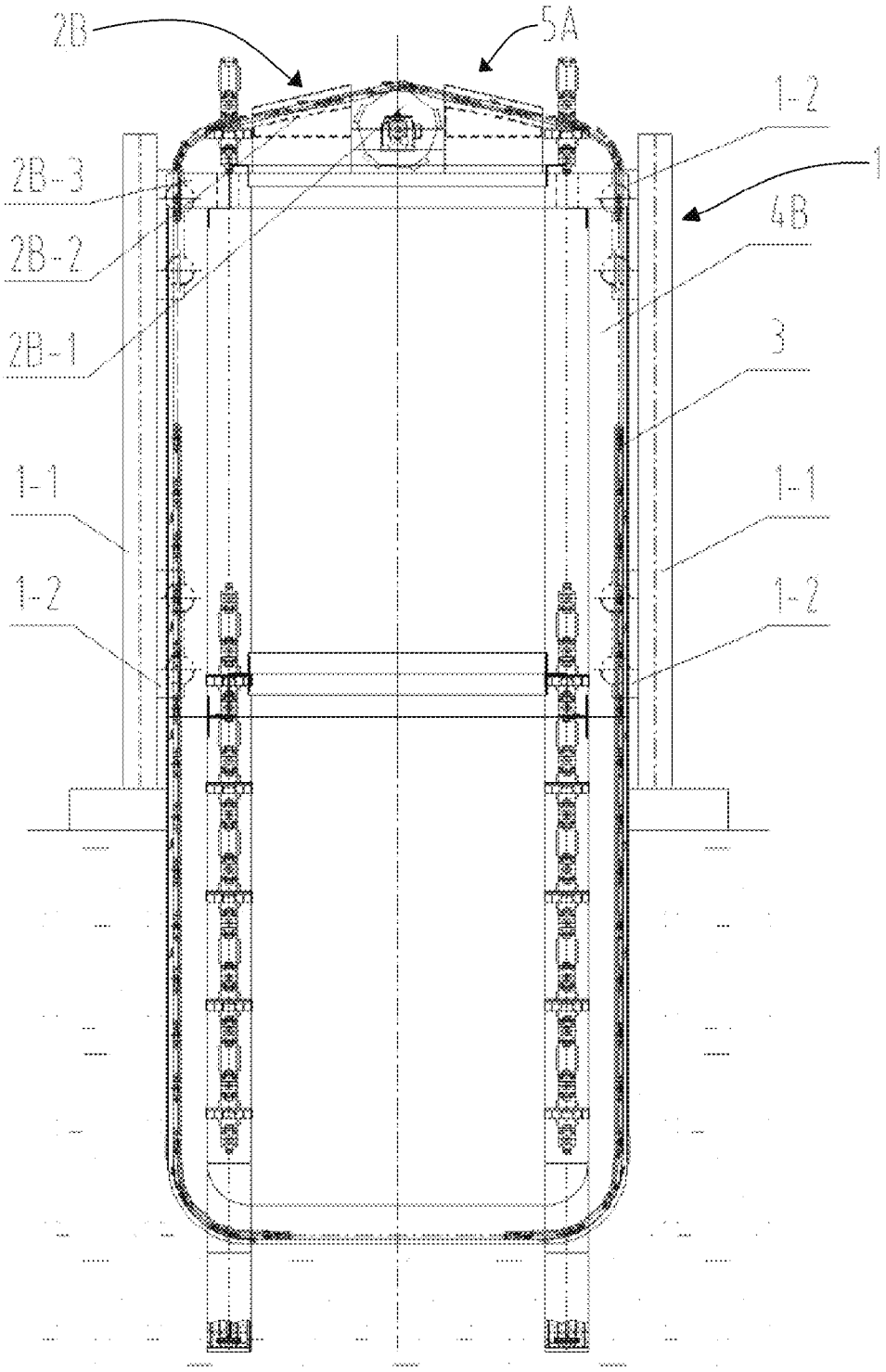
FIG. 8 is the A view of FIG. 7 showing the combined device, comprising a power transmission device, spoil treatment device, and frame, and a chain excavating device.
Figure 9:
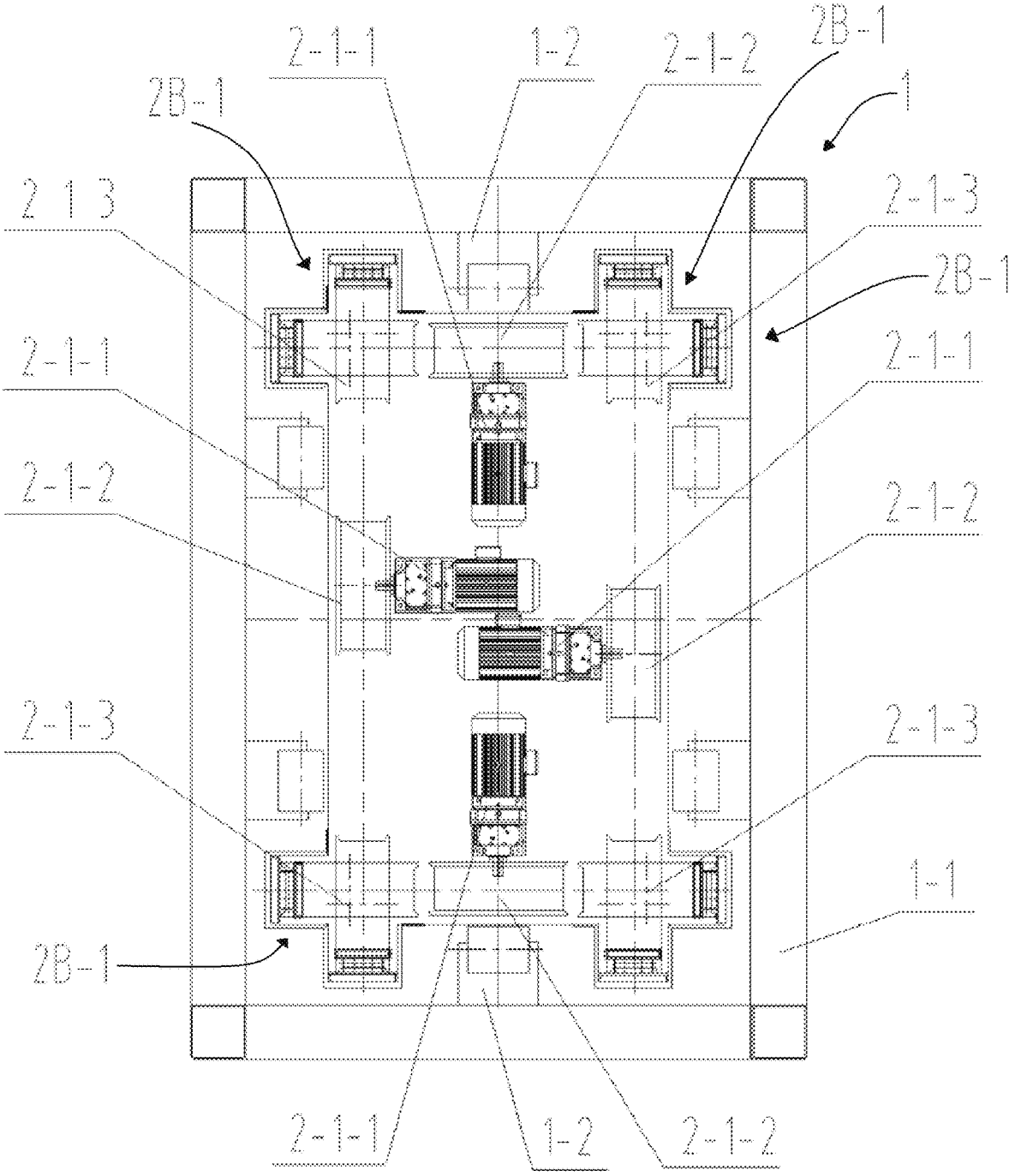
FIG. 9 is the B view of FIG. 7 (excluding the chain blade) showing a power transmission device comprising a chain blade drive device, chain blade tension device, and chain wheel, and also a fixed guide a fixed frame and guide.
Figure 10:
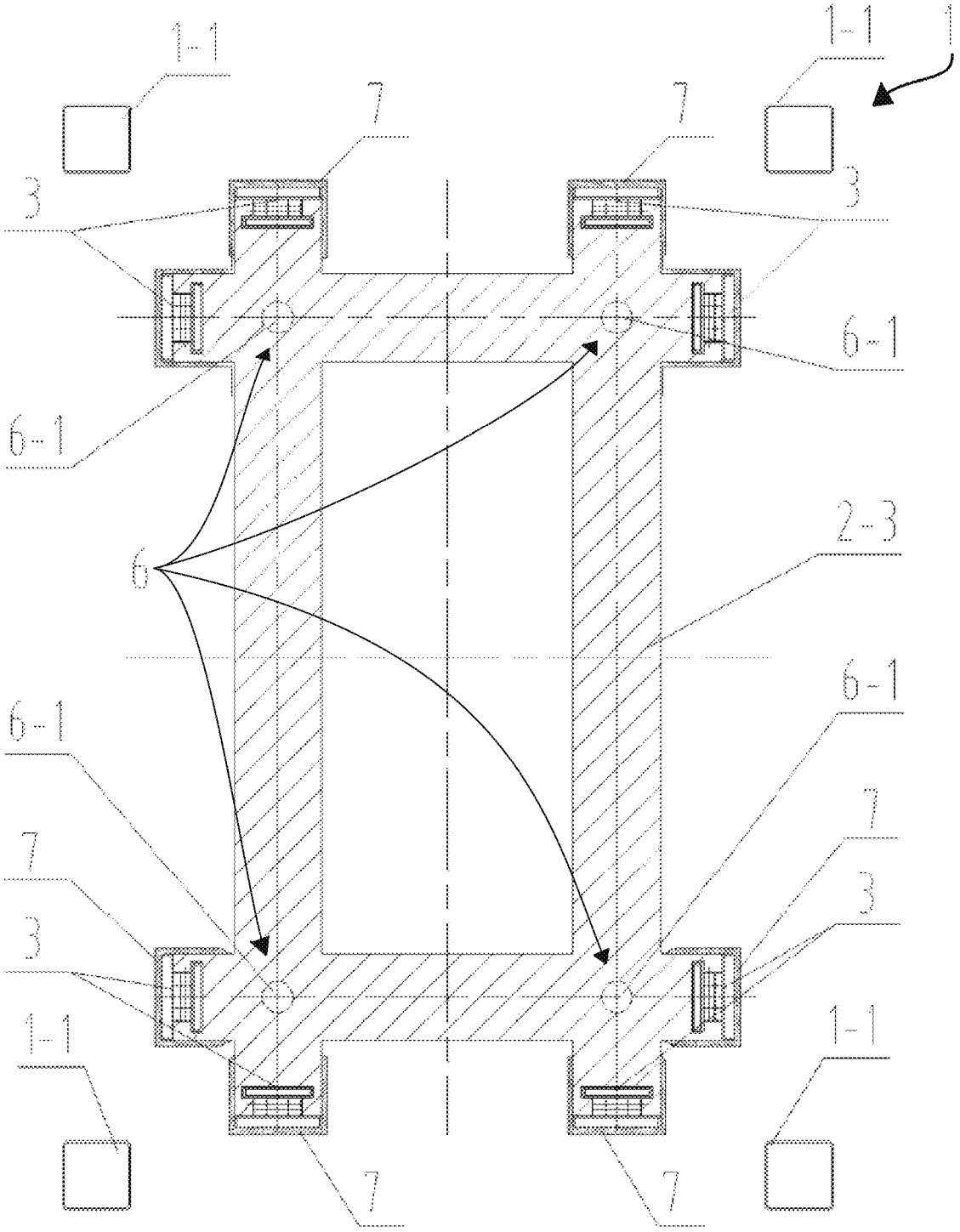
FIG. 10 is the C-C view of FIG. 7, the section view of the frame 2B-3 of combined device 2B, the section view of fixed frame 1-1, and also the structural schematic diagram of slurry pipeline 6-1 of slurry pipeline device 6.
Figure 11:
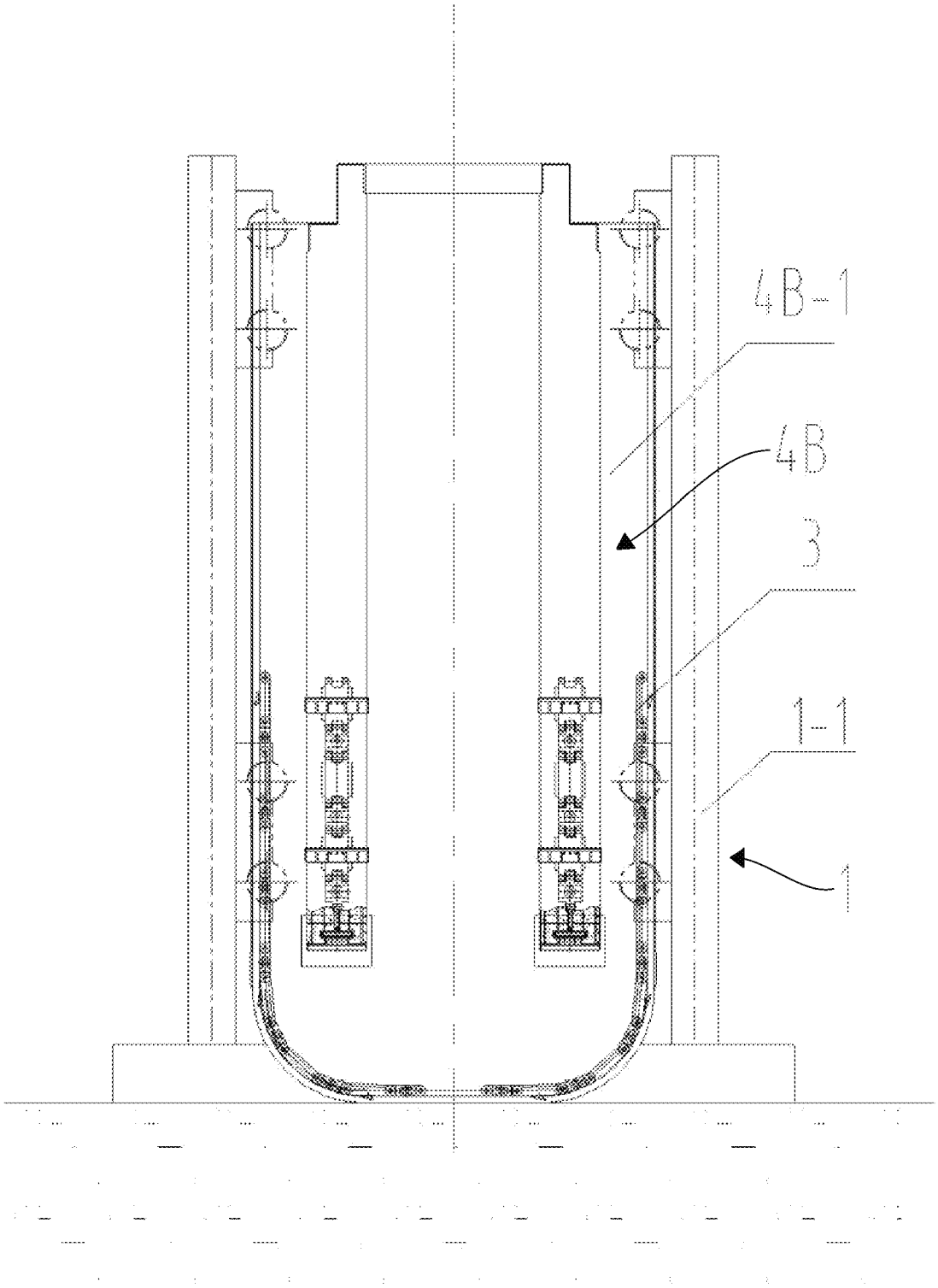
FIG. 11 is the structural schematic diagram of the prefabricated part of the first section of combined foundation 4B-1, and also the structural schematic diagram of the first section of combined foundation 4B-1 with fixed frame 1-1 installed on the spot and chain blade 3 installed.
Figure 12:
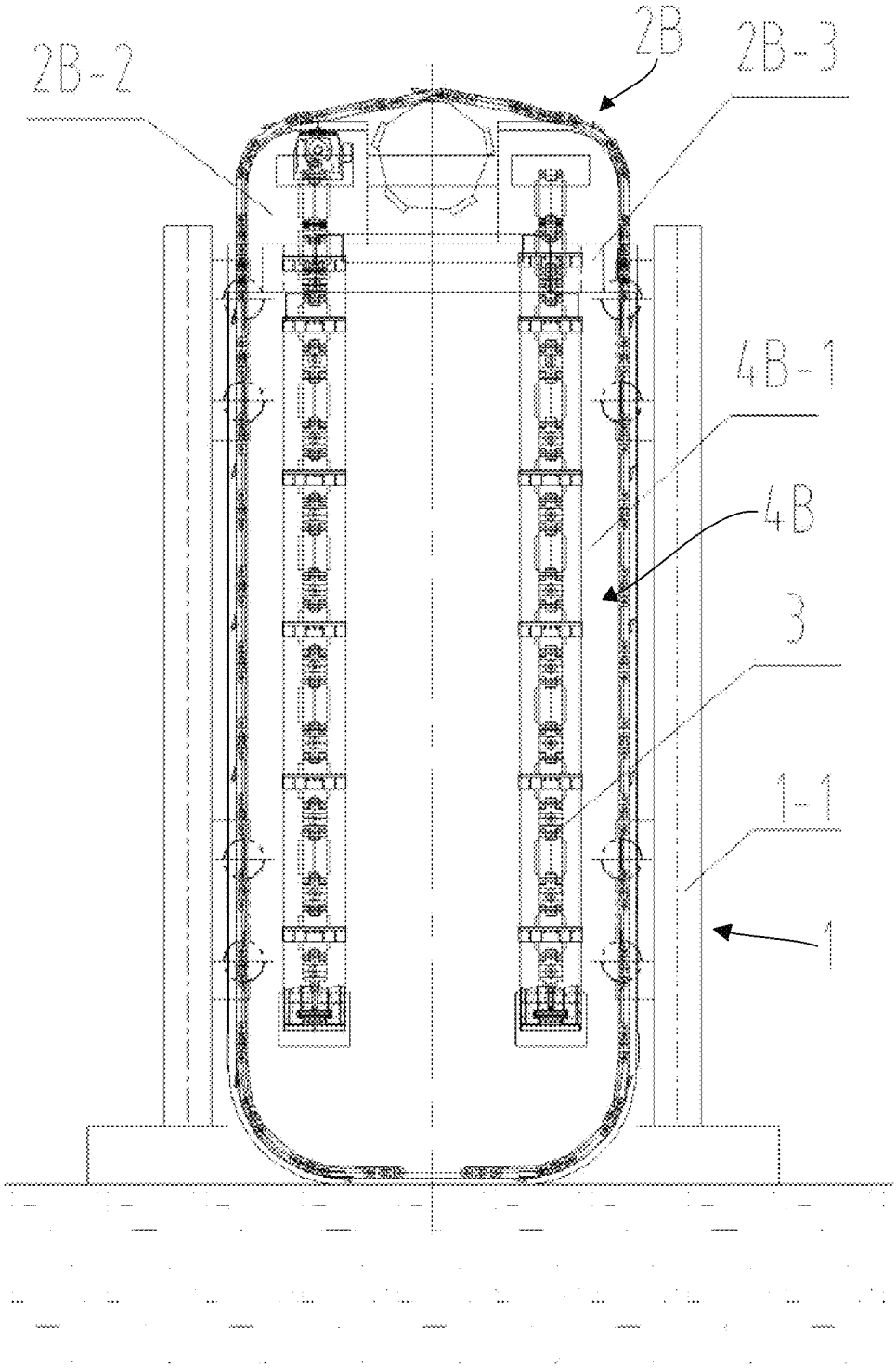
FIG. 12 is the structural schematic diagram of the connection between the bottom of frame 2B-3 in device 2B and the top of the first section of combined foundation 4B-1, and also the structural schematic diagram of the connection between chain blade 3 at the bottom of device 2B and the top of the first section of combined foundation 4B-1.
Figure 13:
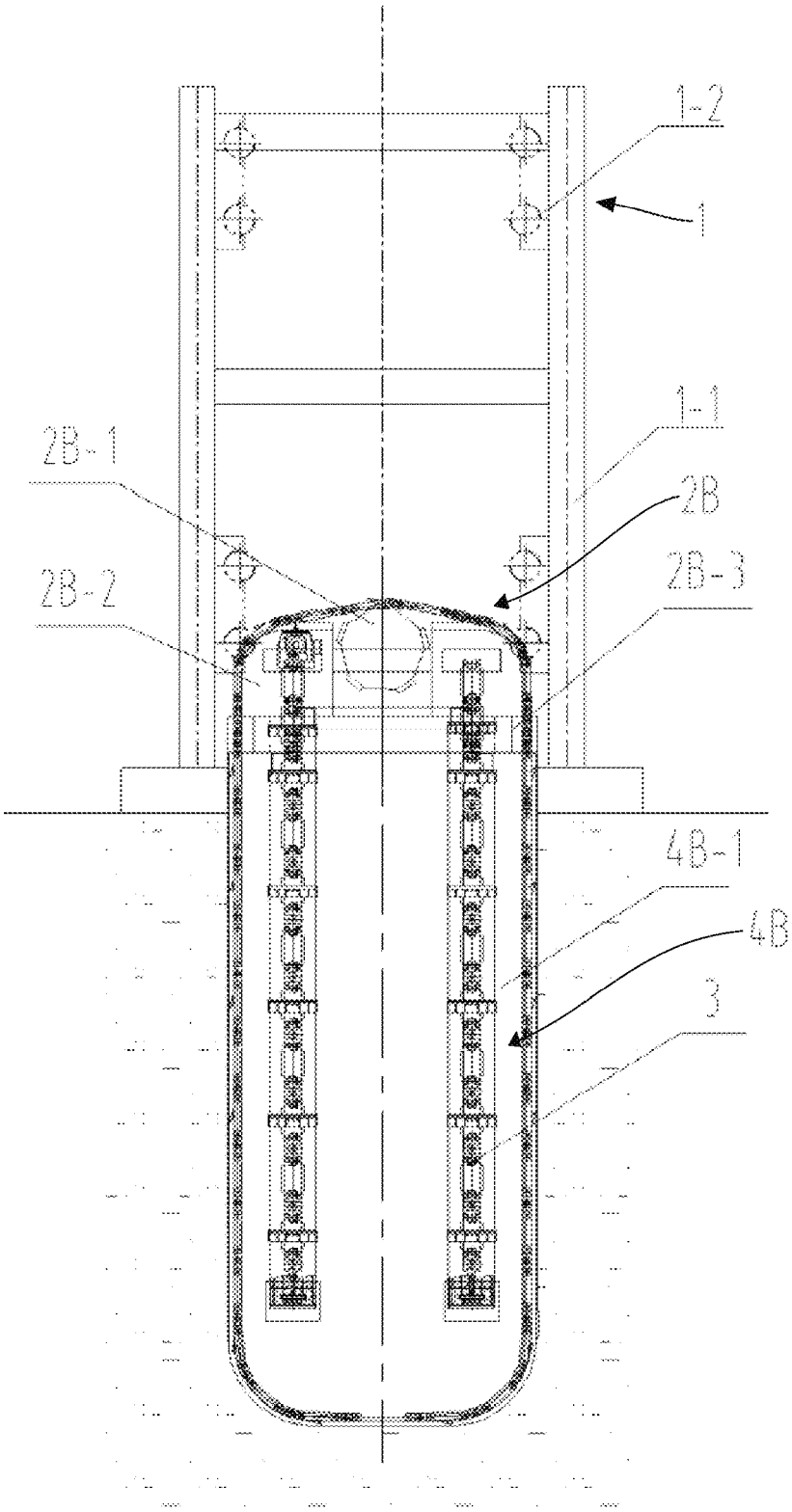
FIG. 13 is the structural schematic diagram of device 2B-1 driving chain blade 3 to run along the track of foundation 4B, chain blade 3 excavating the rock and soil at the bottom of the first section of foundation 4B-1, and device 2B descending synchronously with the first section of foundation 4B-1 to the set position.
Figure 14:
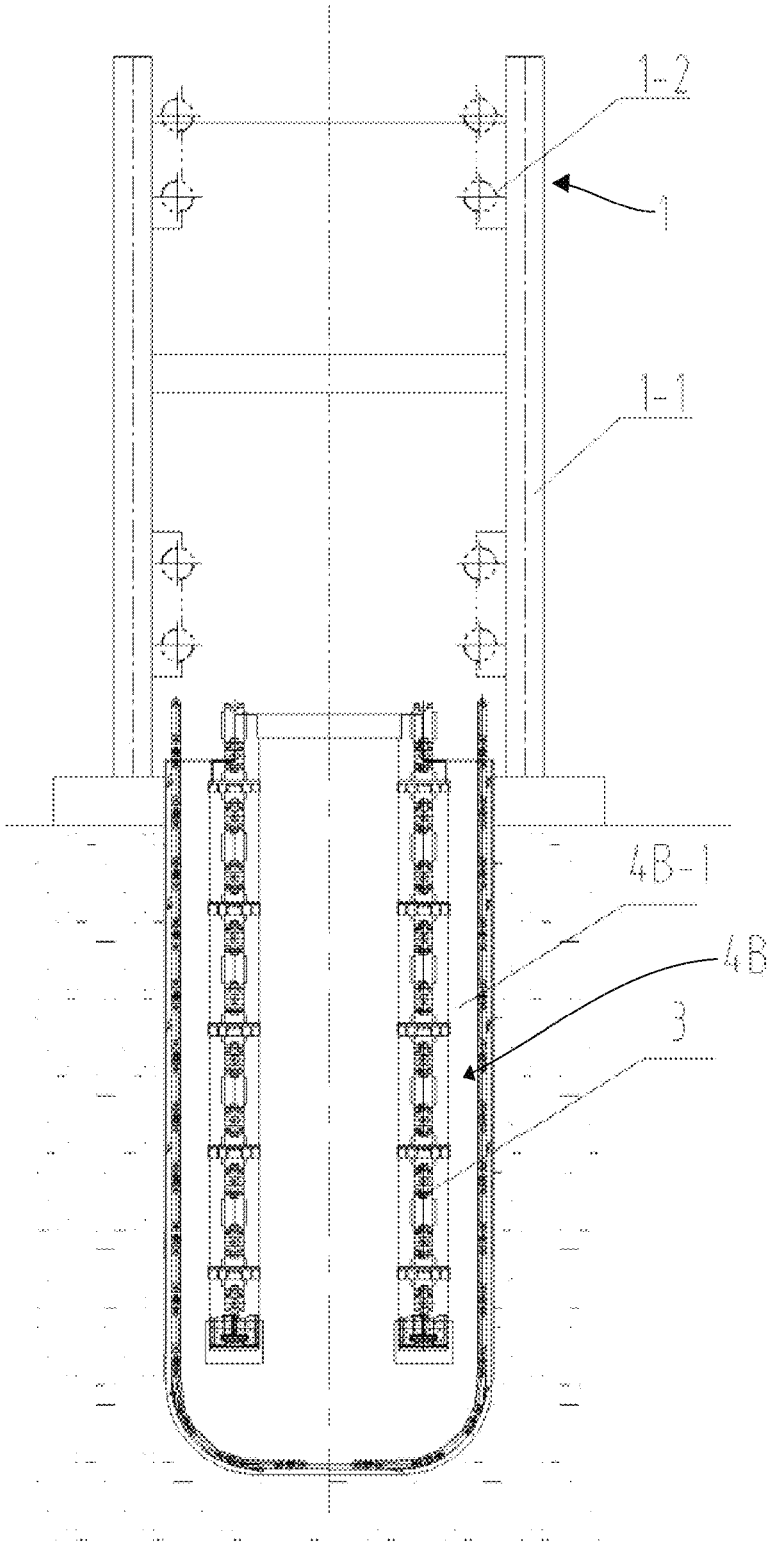
FIG. 14 is the structural schematic diagram of moving device 2B from the first section of foundation 4B-1.
Figure 15:
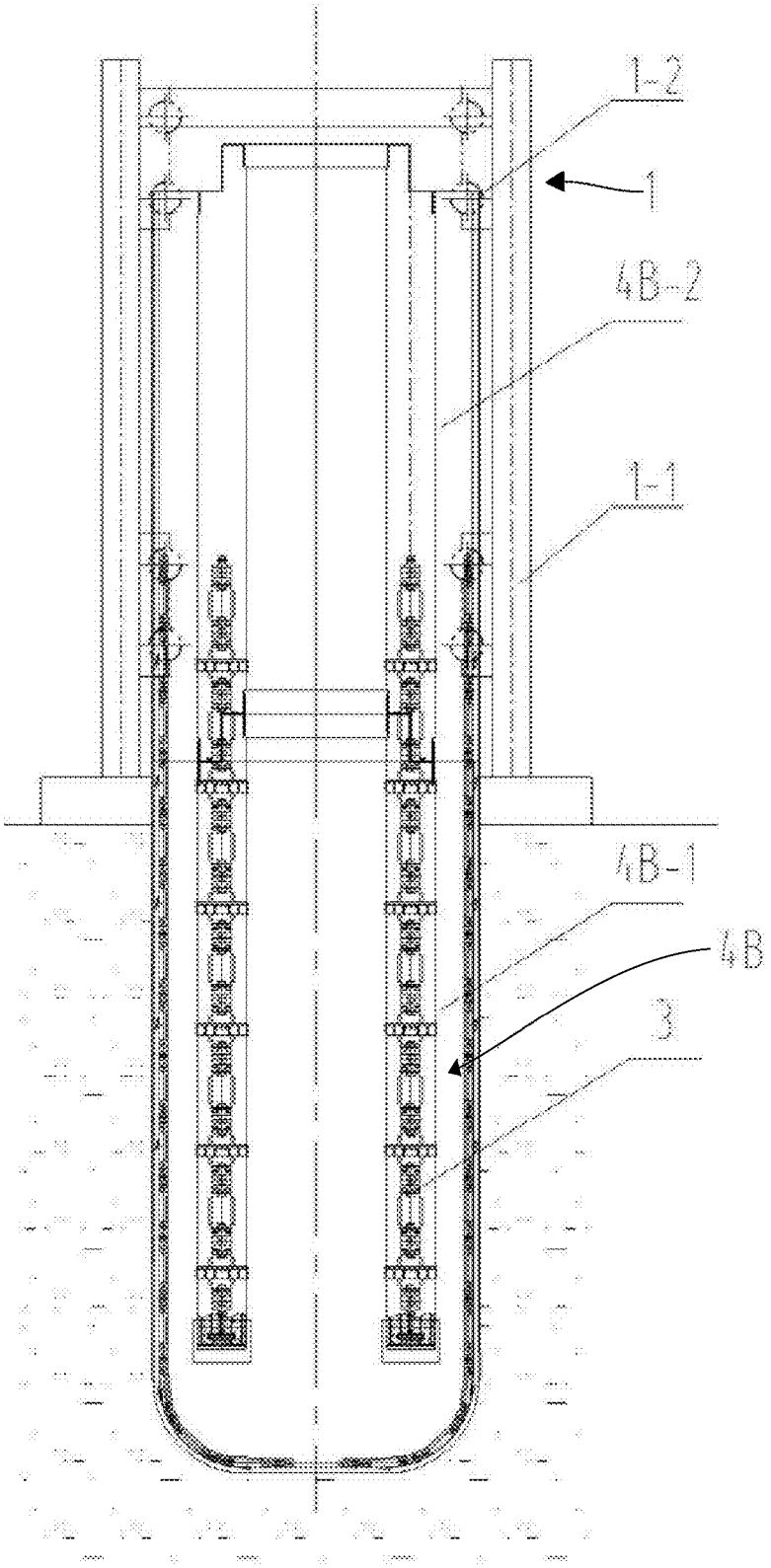
FIG. 15 is the structural schematic diagram of loading the second section of foundation 4B-2 into frame 1-1 and connecting the bottom of foundation 4B-2 and the top of the first section of foundation 4B-1, and also the structural schematic diagram of connecting chain blade 3 at the bottom of the second section of foundation 4B-2 and chain blade 3 at the top of the first section of foundation 4B-1.
Figure 16:
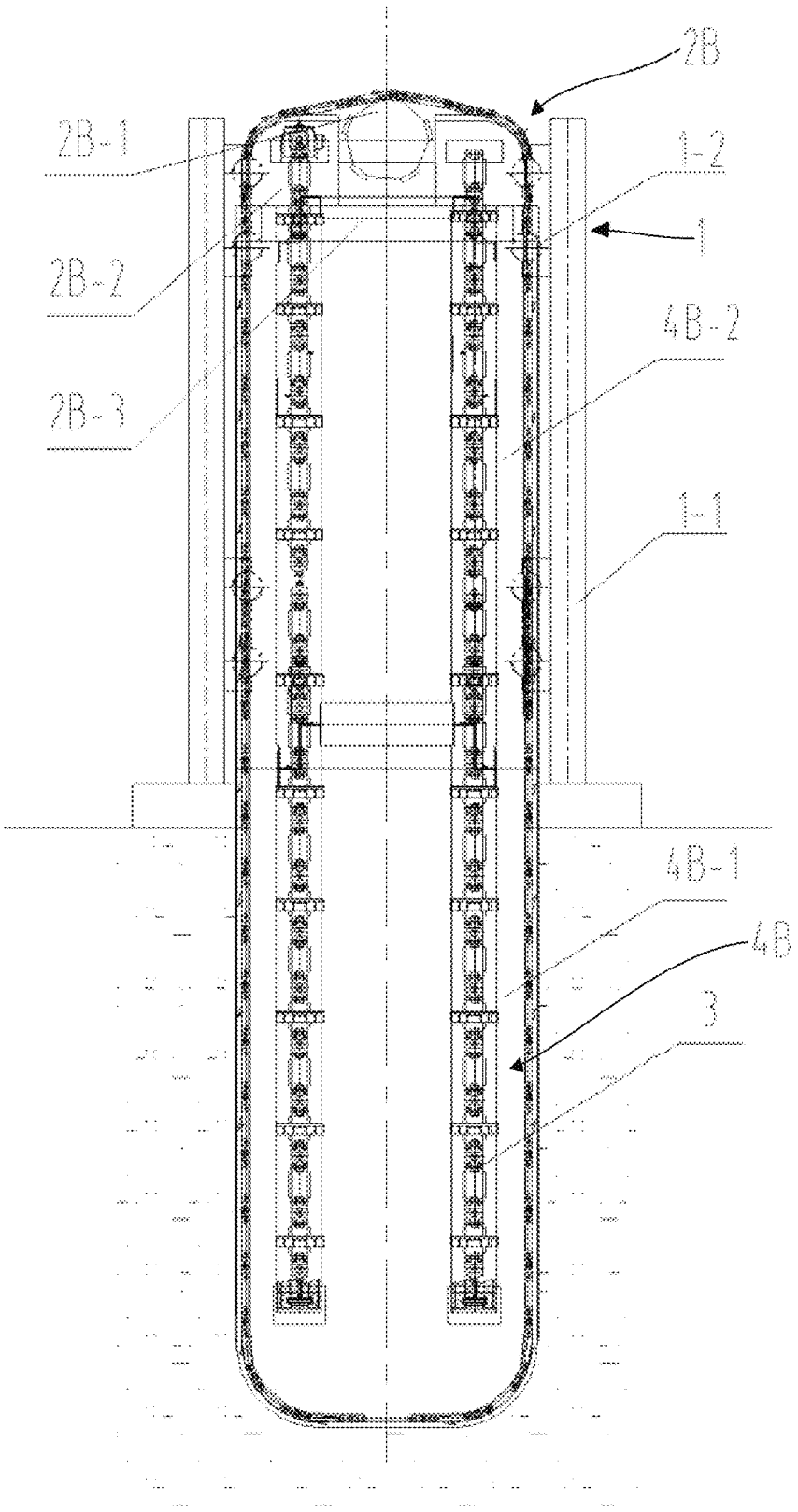
FIG. 16 is the structural schematic diagram of connecting the bottom of frame 3 in device 2B and the top of the second section of foundation 4B-2, and also the structural schematic diagram of connecting chain blade 3 at the bottom of device 2B and chain blade 3 at the top of the second section of foundation 4B-2.
Figure 17:
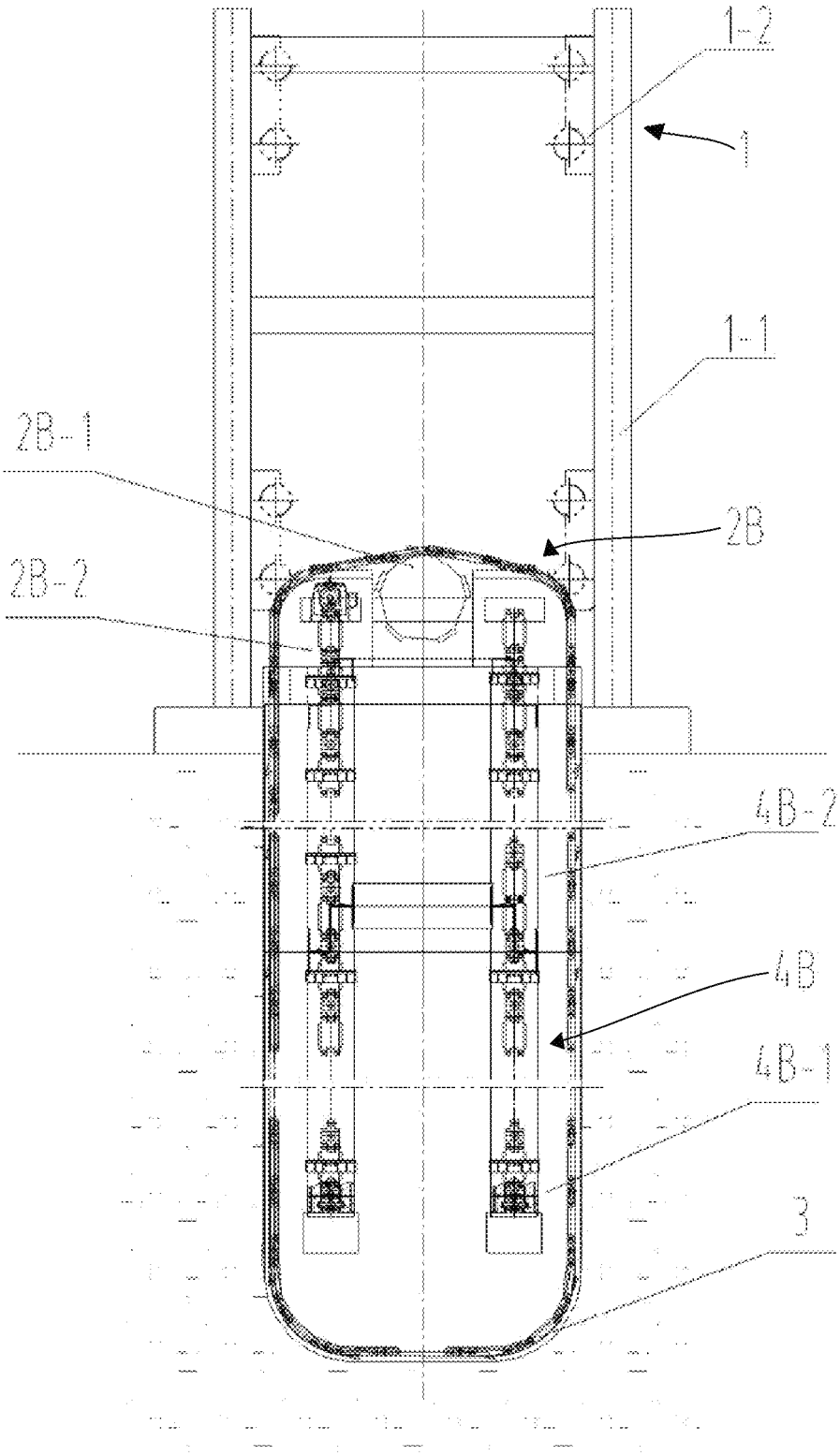
FIG. 17 is the structural schematic diagram of device 2B-1 driving chain blade 3 to move along the trace of foundation 4B and chain blade 3 excavating the rock and soil at the bottom of the first section of foundation 4B-1 and transporting the excavated rock and soil to the top, and also the structural schematic diagram of device 2B, the first section of foundation 4B-1, and the second section of foundation 4B-2 descending synchronously to the set position.
Figure 18:
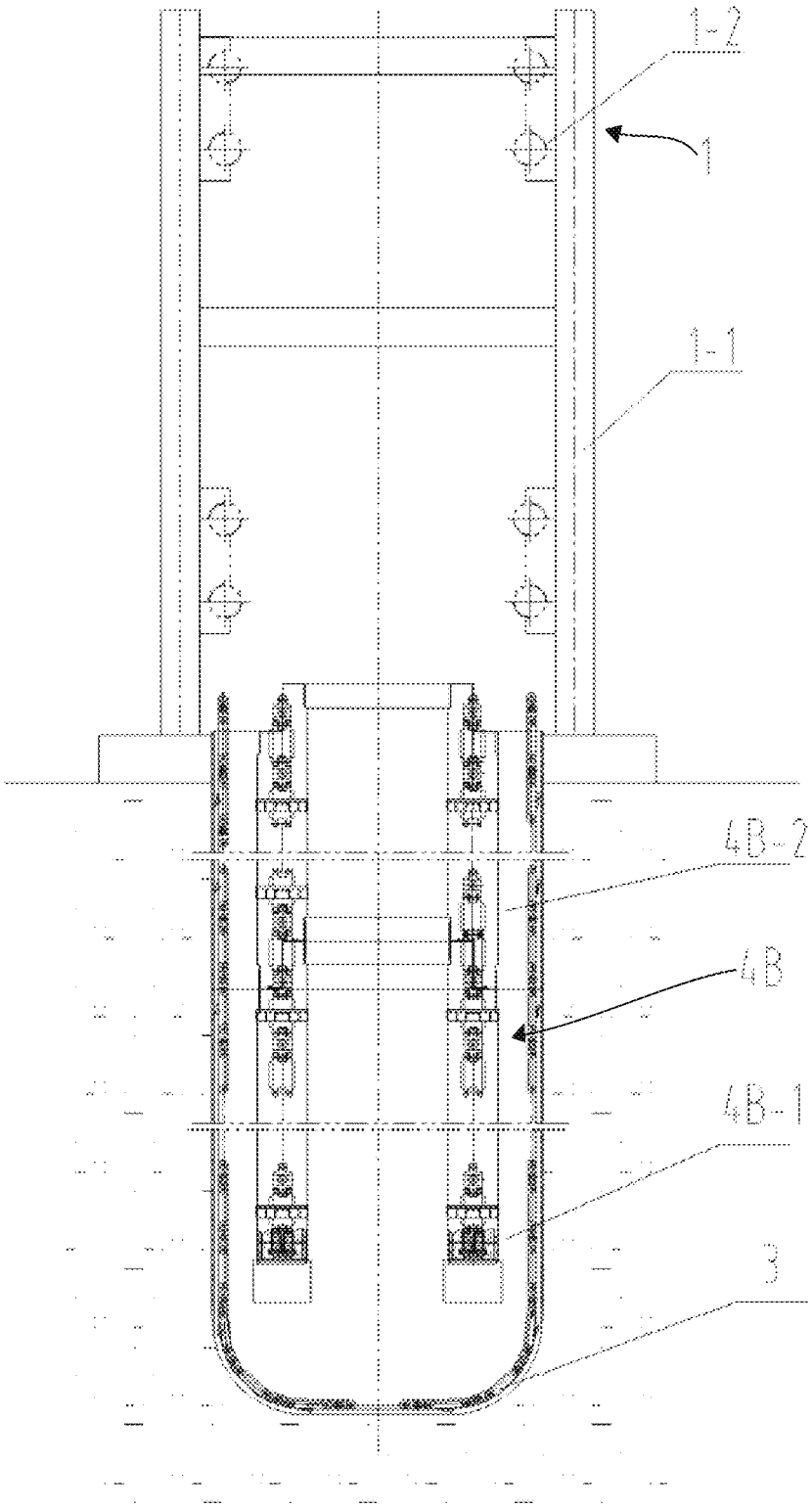
FIG. 18 is the structural schematic diagram of removing device 2B from the second section of foundation 4B-2.
Figure 19:
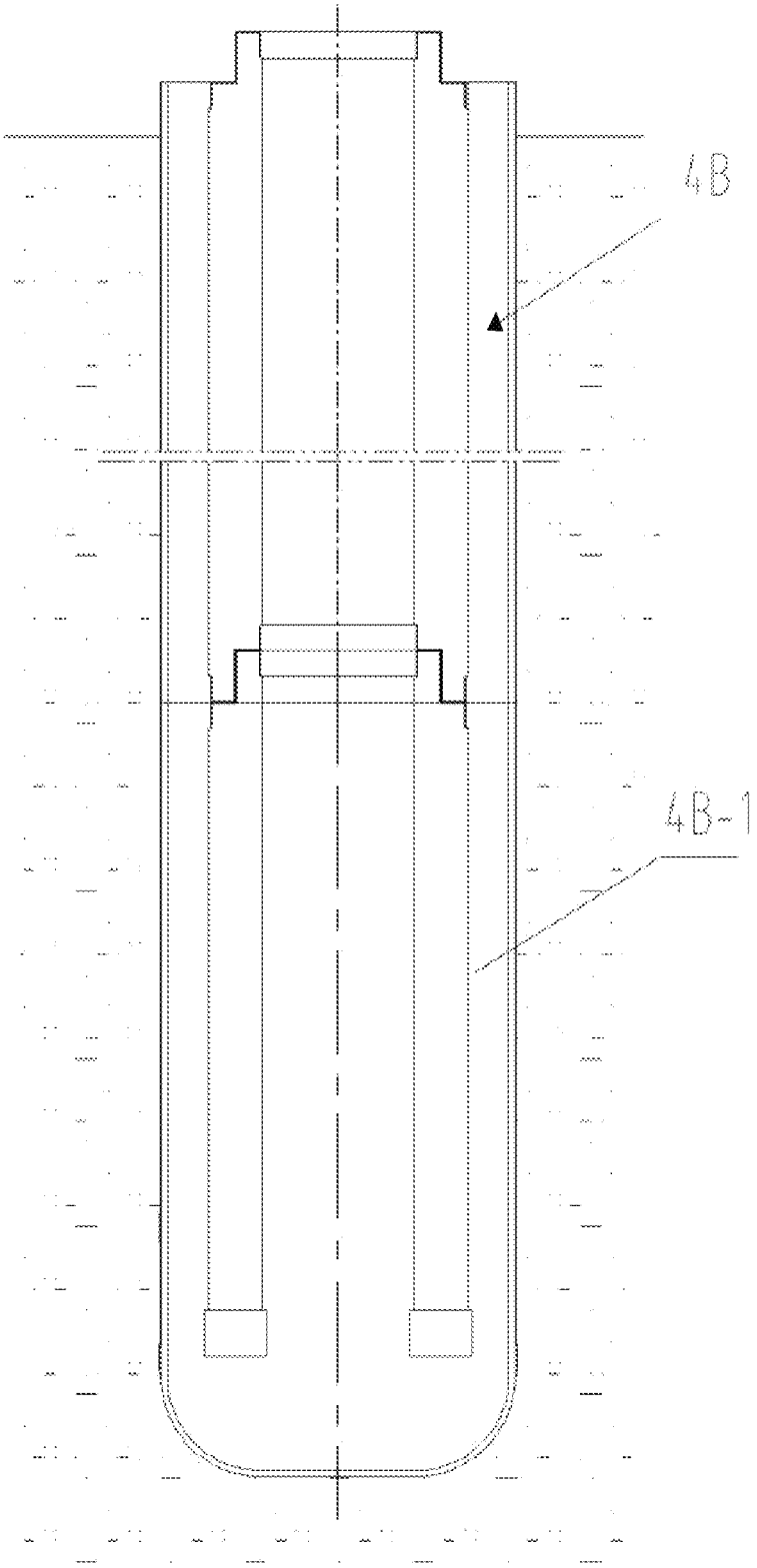
FIG. 19 is the structural schematic diagram of concrete pouring by pulling out the chain blade 3 after foundation 4B descends to the set position.

The Present Invention is Further Described Below in Conjunction with the Drawings Attached:

As shown in FIGS. 1, 2, and 6, the foundation construction device includes fixed guide 1 and combined device 2, which is used for the construction of foundation 4 with chain blade 3 at the bottom. Device 1 is composed of fixed frame 1-1 and guide 1-2. Foundation 4 is slot-type foundation 4A. During construction, combined device 2A connected with the top of slot-type foundation 4A includes power transmission device 2A-1, spoil treatment device 2A-2, and frame 2A-3. Device 2A-1 and device 2A-2 are installed on frame 2A-3. Device 2A-1, foundation 4A and chain blade 3 constitute chain excavating device 5A. Foundation 4A is the frame of chain excavating device 5A. Chain blade 3 excavates the rock and soil at the bottom of foundation 4A only. Chain blade 3 is composed of chain 3-1 and cutter fixed on chain 3-1 for rock and soil excavation. Device 1 guides foundation 4A and/or device 2A to make foundation 4A in a straight state. During construction, device 2A is connected with the top of foundation 4A, and device 2A-1 drives chain blade 3 to run along the track of foundation 4A. Chain blade 3 excavates the rock and soil at the bottom of foundation 4A, and transports the excavated rock and soil to the top. Device 2A-2 separates the rock and soil transported from the bottom of foundation 4A by chain blade 3 from chain blade 3, and device 2A and foundation 4A descend synchronously.

Figure 3:
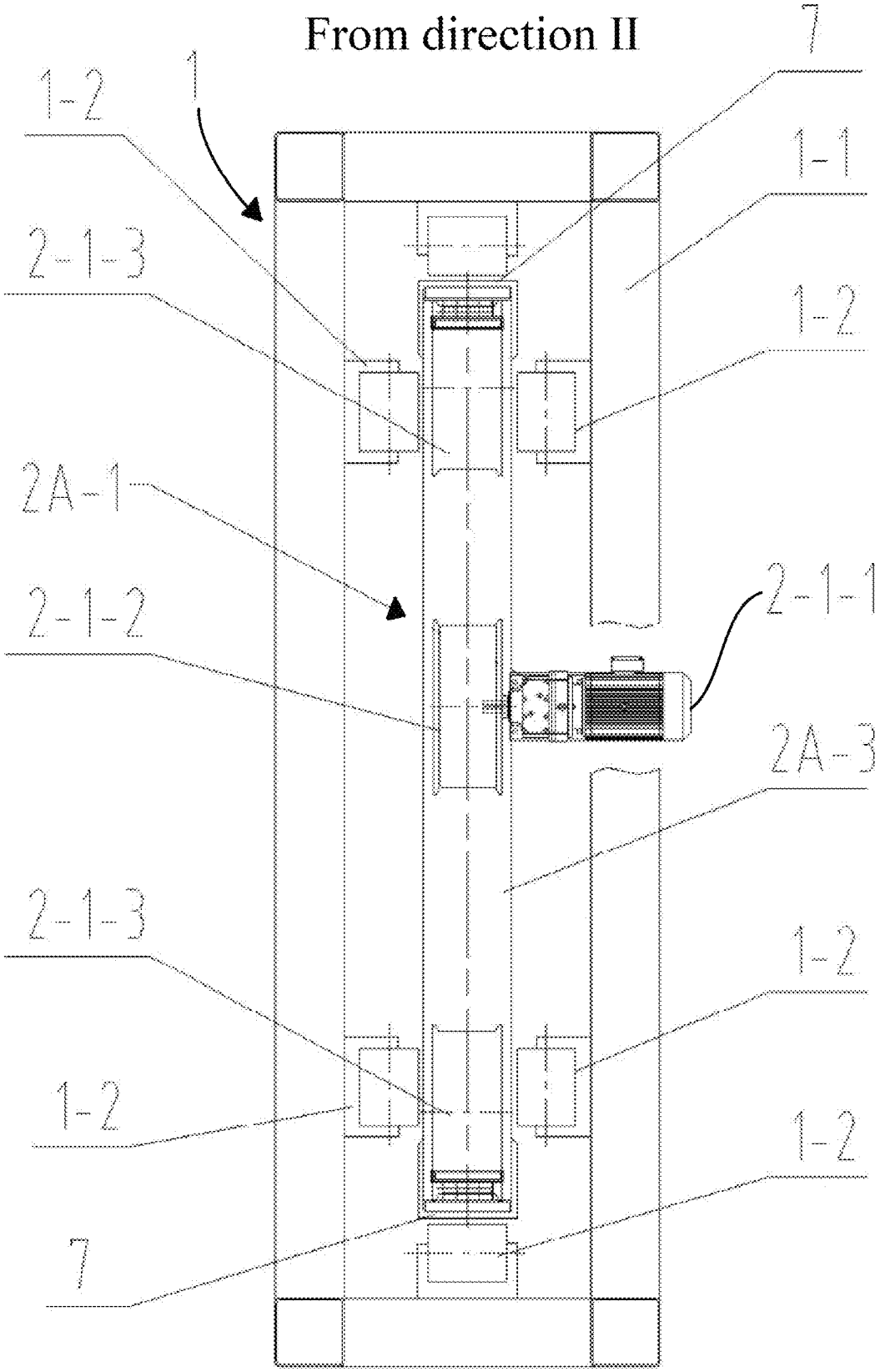
FIG. 3 is the B-view of FIG. 1 showing a power transmission device comprising a chain blade drive device, a chain blade tension device, and a chain wheel.

As shown in FIG. 3, foundation 4 is slot-type foundation 4A. Device 2A-1 is composed of chain blade drive device 2-1-1, chain blade tension device 2-1-2, and chain wheel 2-1-3.

Figure 4:
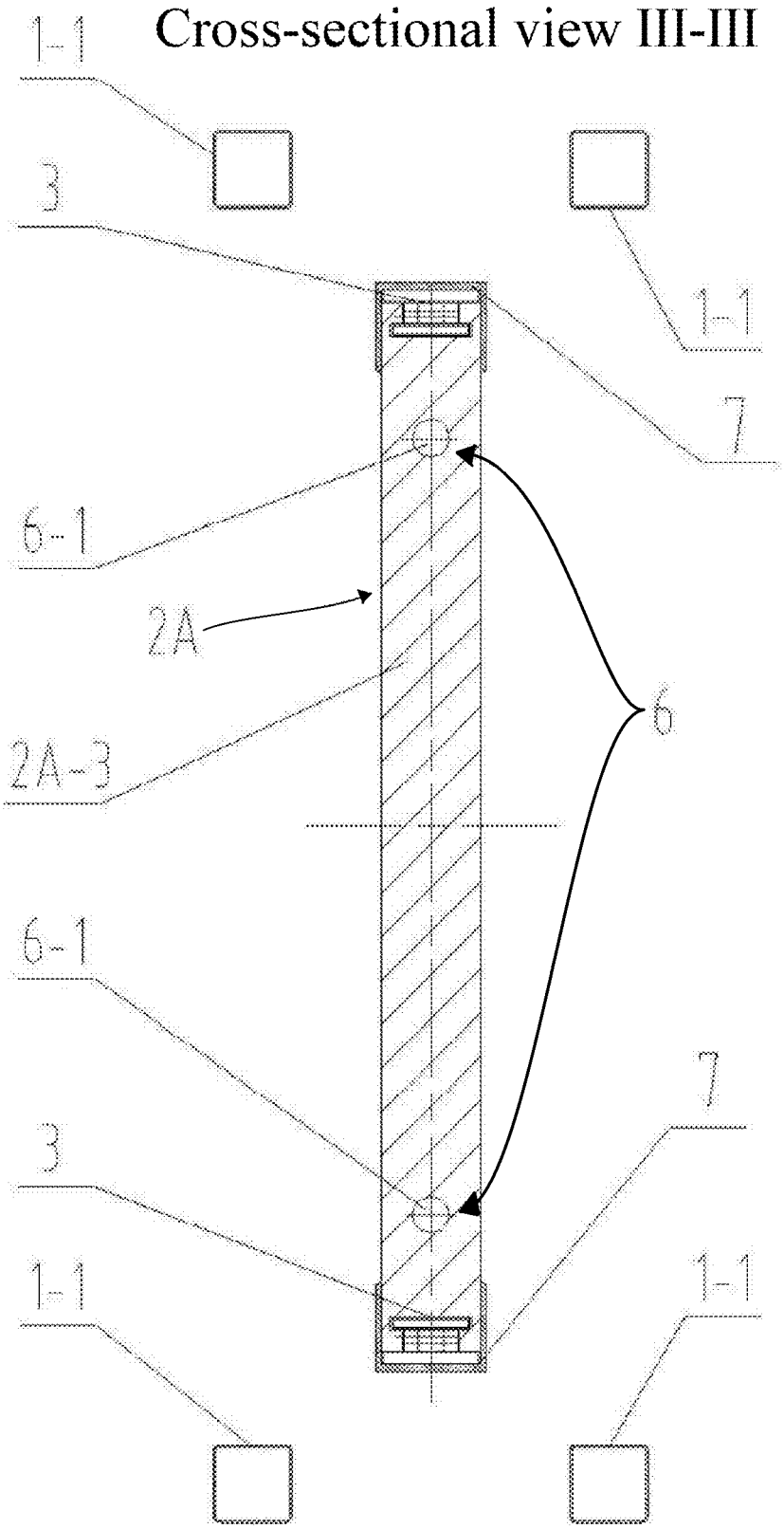
FIG. 4 is the C-C-view of FIG. 1 showing a sectional view of the combined device, frame, and slurry pipeline.
Figure 5:
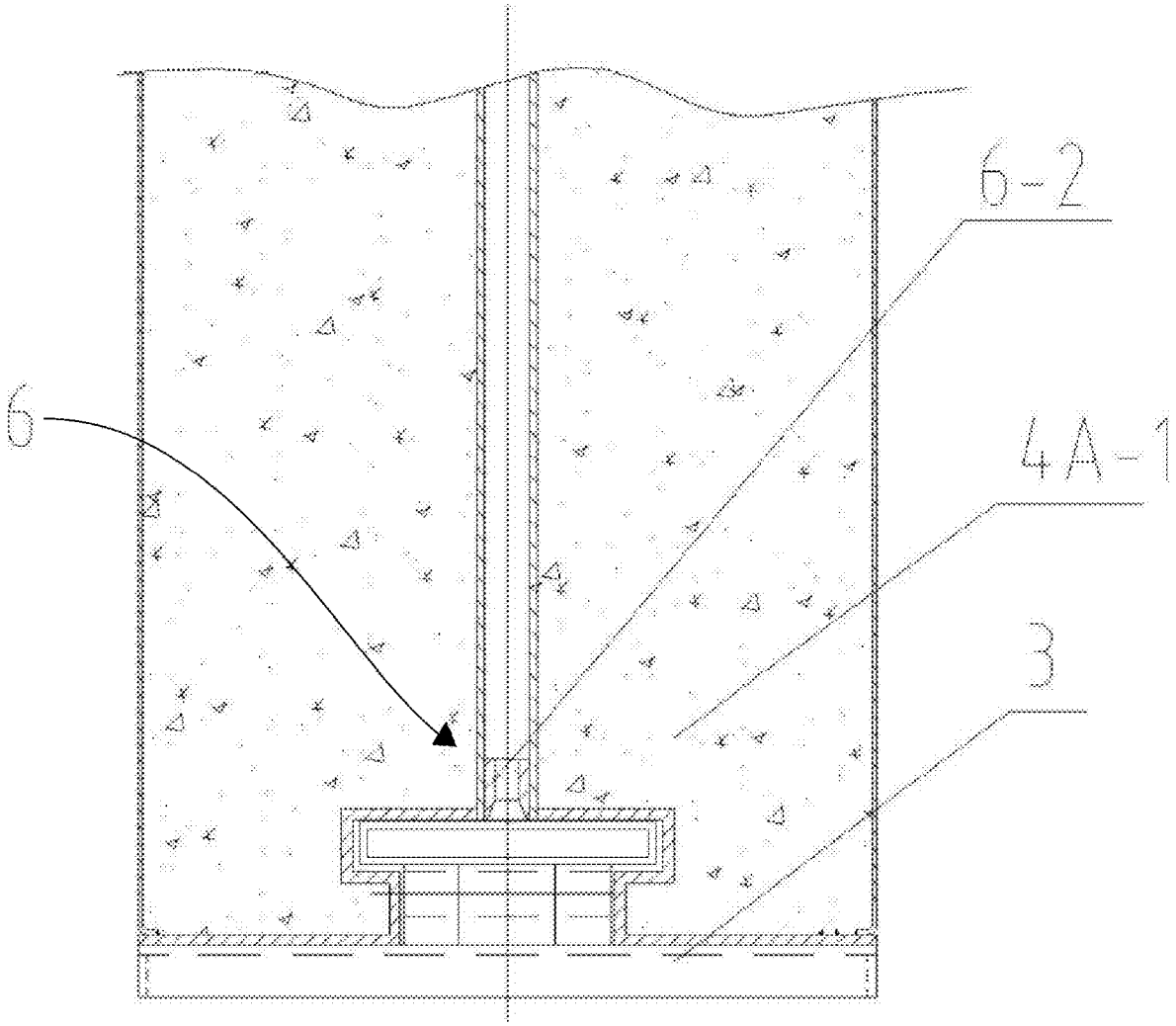
FIG. 5 is the D-D view of FIG. 1 showing a slurry nozzle of a foundation bottom.

As shown in FIGS. 4-5, foundation 4 is slot-type foundation 4A. Frame 2A-3 in device 2A includes slurry pipeline device 6. Slurry pipeline 6-1 is connected with slurry nozzle 6-2 at the bottom of foundation 4A.

As shown in FIGS. 7-10, foundation 4 is combined foundation 4B, which is composed of several slot-type foundations 4A. Each slot-type foundation 4A is equipped with chain excavating device 4A that excavates the rock and soil at the bottom of respective foundation only, that is, rack 2B-3 of device 2B is equipped with several devices 2A-1.

As shown in FIGS. 11-19, foundation 4 is combined foundation 4B, and the construction method is divided into the following steps:

1) Pre-fabricate foundation 4B by blocks at the factory;

2) Install and fix frame 1-1 on the spot;

3) Transport the first section (i.e. bottom section) of foundation 4B-1 to the site, load it into fixed frame 1-1, and install chain blade 3;

4) Connect the bottom of frame 2B-3 in device 2B with the top of the first section of foundation 4B-1, connect chain blade 3 at the bottom of device 2B with the chain blade 3 at the top of the first section of foundation 4B-1 to constitute chain excavating device 5B, and connect slurry pipeline 6-1 at the bottom of device 2B with slurry pipeline 6-1 at the top of the first section of foundation 4B-1;

5) Start device 2-1-1, so that device 2-1-1 drives chain blade 3 to move along the track of foundation 4B-1, chain blade 3 excavates the rock and soil at the bottom of the first section of foundation 4B-1 and transports the excavated rock and soil to the top, and device 2B-2 separates the rock and soil transported by chain blade 3 from the bottom of foundation 4B-1 from chain blade 3;

6) Device 2B and the first section of foundation 4B-1 descend synchronously to the set position;

7) Separate and remove device 2B from the first section of foundation 4B-1;

8) Load the second section of foundation 4B-2 into frame 1-1;

9) Connect the bottom of the second section of foundation 4B-2 with the top of the first section of foundation 4B-1, connect chain blade 3 at the bottom of the second section of foundation 4B-2 with chain blade 3 at the top of the first section of foundation 4B-1, and connect slurry pipeline 6-1 at the bottom of the second section of foundation 4B-2 with slurry pipeline 6-1 at the top of the first section of foundation 4B-1;

10) Connect the bottom of rack 2-3 in device 2B with the top of the second section of foundation 4B-2, connect chain blade 3 at the bottom of device 2 with chain blade 3 at the top of the second section of foundation 4B-2 to constitute chain excavating device 5B, and connect slurry pipeline 6-1 at the bottom of device 2B with slurry pipeline 6-1 at the top of the second section of foundation 4B-2;

11) Start device 2-1-1, so that device 2-1-1 drives chain blade 3 to move along the track of foundation 4B, chain blade 3 excavates the rock and soil at the bottom of the first section of foundation 4B-1 and transports the excavated rock and soil to the top, and device 2B-2 separates the rock and soil transported by chain blade 3 from the bottom of foundation 4B from chain blade 3;

12) Device 2B, first section of foundation 4B-1, and second section of foundation 4B-2 descend synchronously to the set position;

13) Separate and remove device 2B from the second section of foundation 4B-2;

Repeat the above steps 7), 8), 9), 10), 11), and 12) to complete the connection of each section of the foundation and descend to the set position, and then pull out chain blade 3 for concrete pouring.

The invention claimed is:

1. A foundation construction device for the construction of a foundation, the foundation construction device comprising:

a fixed guide to make the foundation in a straight state, the fixed guide comprising a fixed frame and a guide;

a combined device to connect to the top of the foundation, the combined device comprising a chain blade power transmission device, a spoil treatment device, and a rack, the chain blade power transmission device and the spoil treatment device being installed on the rack; and a chain blade to excavate rock and soil at the bottom of the foundation and transport the excavated rock and soil to the top, the chain blade comprising a chain and a cutter that is fixed on the chain for rock and soil excavation, whereby during operation the fixed guide guides the foundation and/or the combined device to make the foundation in a straight state, the chain blade power transmission device drives the chain blade to run along a track of the foundation, the spoil treatment device separates the rock and soil transported from the bottom of the foundation by the chain blade from the chain blade, and the combined device and the foundation descend synchronously.

2. The foundation construction device of claim 1, wherein the chain blade power transmission device comprises a chain blade drive device, a chain blade tension device, and a chain wheel.

3. The foundation construction device of claim 1, wherein the rack is adapted to move within the guide.

4. The foundation construction device of claim 1, wherein the guide is adapted such that the foundation can move within the guide.

5. The foundation construction device of claim 1, wherein the fixed frame comprises a machinery/construction vehicle or machinery/construction ship.

6. The foundation construction device of claim 1, wherein the foundation is a slot-type foundation adapted to be equipped with a chain excavating device to excavate rock and soil at the bottom of the foundation.

7. The foundation construction device of claim 1, wherein the foundation is a combined foundation comprising a plurality of slot-type foundations, whereby during operation each slot-type foundation is equipped with a chain excavating device to excavate rock and soil at a bottom one of the foundations.

8. The foundation construction device of claim 1, wherein the rack of the combined device comprises a slurry pipeline device, the slurry pipeline device comprising a slurry pipeline connected with a slurry nozzle at the bottom of the foundation.

9. The foundation construction device of claim 1, wherein the fixed frame is a construction platform of the foundation, with a lifting device installed at the top.

10. A method of foundation construction, the method comprising:

1) pre-fabricating a foundation by sections or integrally at a factory;

2) installing and fixing a frame at a foundation-construction site;

3) transporting a first, bottom section of the foundation to the site, loading the first section into the fixed frame, and installing a chain blade at the first section;

4) connecting the bottom of a rack with the top of the first section of the foundation, connecting the chain blade with a chain blade at the top of the first section of the foundation;

5) driving the chain blade to move along a track of the foundation, excavating the rock and soil at the bottom of the first section of the foundation, transporting the excavated rock and soil to the top, and separating the rock and soil transported from the bottom of the foundation;

6) lowering the combined device and the first section of foundation (4-1) synchronously to a set position;

7) separating and removing the rack from the first section of the foundation;

8) loading the second section of the foundation into the frame;

9) connecting the bottom of the second section of the foundation with the top of the first section of the foundation, connecting the chain blade at the bottom of the second section of the foundation with the chain blade at the top of the first section of the foundation;

10) connecting the bottom of the rack with the top of the second section of the foundation, connecting the chain blade with the chain blade at the top of the second section of the foundation;

11) driving the chain blade to move along the track of the foundation, excavating the rock and soil at the bottom of the first section of the foundation and transporting the excavated rock and soil to the top, and separating the rock and soil transported from the bottom of the foundation;

12) lowering the rack, the first section of the foundation, and the second section of the foundation synchronously to a set position;

13) separating and removing the rack from the second section of the foundation;

14) repeating the above steps 7), 8), 9), 10), 11), and 12) to complete the connection of each section of the foundation and lowering to the set position, and then pulling out the chain blade for concrete pouring.

* * * * *